United States Patent [19]

Borst

[11] Patent Number: 4,913,103

[45] Date of Patent: Apr. 3, 1990

[54] MARINE PROPULSION DEVICE LOW LIQUID PRESSURE WARNING SYSTEM

[75] Inventor: Gaylord M. Borst, Highland Park, Ill.

[73] Assignee: Outboard Marine Corporation, Waukegan, Ill.

[21] Appl. No.: 261,672

[22] Filed: Oct. 24, 1988

[51] Int. Cl.[4] ..... F02B 77/08

[52] U.S. Cl. ..... 123/41.15; 123/198 D

[58] Field of Search .... 123/198 D, 198 DB, 198 DC, 123/41.15, 196 S; 440/2; 73/116; 116/112, 137 R, 138, 142 FV, 266, 268, DIG. 7, 67 R, 70, 272; 184/6.4, 108; 137/557

[56] References Cited

U.S. PATENT DOCUMENTS

| | | | |
|---|---|---|---|
| 828,262 | 8/1906 | Adams | 123/41.15 |
| 1,339,798 | 5/1920 | Thompson | 184/6.4 |
| 1,851,611 | 3/1932 | Wernberg | 123/41.15 |
| 2,003,505 | 6/1935 | Gillet | 116/142 FV |
| 3,202,143 | 8/1965 | Goodwin | 123/41.51 |
| 3,590,798 | 7/1971 | Goodwin | 123/198 D |
| 3,595,262 | 7/1971 | Fox | 137/457 |
| 4,029,074 | 6/1977 | Sliger | 123/198 D |
| 4,117,822 | 10/1978 | Mills | 123/198 DB |
| 4,126,114 | 11/1978 | Davis | 123/198 D |
| 4,278,056 | 7/1981 | Davis | 123/198 D |
| 4,483,287 | 11/1984 | Monigold et al. | 123/198 DB |
| 4,485,767 | 12/1984 | Baltz | 123/41.15 |
| 4,526,140 | 7/1985 | Monigold et al. | 123/41.15 |
| 4,695,822 | 9/1987 | Furukawa | 340/53 |

FOREIGN PATENT DOCUMENTS

| | | | |
|---|---|---|---|
| 60459 | 2/1939 | Norway | 123/41.15 |

*Primary Examiner*—Noah P. Kamen

*Attorney, Agent, or Firm*—Michael, Best & Friedrich

[57] ABSTRACT

A marine propulsion device comprising a propulsion unit including a propeller shaft adapted to support a propeller, and an internal combustion engine drivingly connected to the propeller shaft, the engine including a cavity adapted to house a liquid under pressure, a source of gas at a pressure different from atmospheric pressure, a whistle for producing a warning signal in response to communication between the source of gas and the whistle, and a valve for permitting communication between the source of gas and the whistle when the liquid pressure is below a specified value and for preventing communication between the source and the whistle when the liquid pressure is above the specified value.

15 Claims, 1 Drawing Sheet

MARINE PROPULSION DEVICE LOW LIQUID PRESSURE WARNING SYSTEM

BACKGROUND OF THE INVENTION

The invention relates to warning systems for internal combustion engines, and, more particularly, to warning systems sensitive to engine liquid pressures.

The desirability of monitoring engine operating conditions and of providing means to warn the operator of conditions hazardous to the engine or to the operator are known. Many known warning systems require an energy source independent of the engine for operation of the warning means.

SUMMARY OF THE INVENTION

The invention provides a marine propulsion device comprising a propulsion unit including a propeller shaft adapted to support a propeller, and an internal combustion engine drivingly connected to the propeller shaft and including a cooling jacket adapted to contain coolant under pressure, means for providing gas at a pressure different from atmospheric pressure, pneumatic warning means for producing a warning signal in response to communication between the gas providing means and the warning means, valve means movable between a first position permitting communication between the gas providing means and the warning means when the pressure of the coolant is below a specified value and a second position preventing communication between the gas providing means and the warning means when the pressure of the coolant is above the specified value, and a spring biasing the valve means toward the first position.

The invention also provides an engine apparatus comprising an internal combustion engine including a cooling jacket adapted to contain coolant under pressure, means for providing gas at a pressure different from atmospheric pressure, pneumatic warning means for producing a warning signal in response to communication between the gas providing means and the warning means, and valve means for permitting communication between the gas providing means and the warning means when the pressure of the coolant is below a specified value and for preventing communication between the gas providing means and the warning means when the pressure of the coolantis above the specified value.

The invention also provides a marine propulsion device comprising a propulsion unit including a propeller shaft adapted to support a propeller, and an internal combustion engine drivingly connected to the propeller shaft and including a cooling jacket adapted to contain coolant under pressure, means for providinggas at a pressure different from atmospheric pressure, pneumatic warning means for producing a warning signal in response to communication between the gas providing means and the warning means, a cyliner defining a cylinder bore, a passageway communicating with one of the gas providing means and the warning means, a piston dividing the cylinder bore into a first chamber communicating with the other of the gas providing means and the warning means and being communicable with the passageway, and a second chamber communicating with the cooling jacket, valve means for affording communication of the passageway with the first chamber in response to movement of the piston in the direction minimizing the volume of the second chamber, and for preventing communication of the passageway with the first chamber in response to movement of the piston in the direction minimizing the volume of the first chamber, and a spring located in said the chamber and biasing the piston in the direction minimizing the volume of the second chamber.

In one embodiment, the cylinder includes an end wall and the valve means includes means for biasing the piston in the direction minimizing the volume of the second chamber, the piston biasing means including a piston return spring extending between the end wall and the piston.

In one embodiment, the valve means includes a valve seat, a valve member movable into and out of engagement with the valve seat for respectively closing and opening the passageway, means for biasing the valve member toward the valve seat when the volume of the first chamber is greater than a predetermined volume, and means for moving the valve member into engagement with the valve seat when the volume of the first chamber is less than the predetermined volume.

In one embodiment, the engine is a two-cycle engine having a crankcase, and the crankcase is the source of gas.

In one embodiment, the passageway communicates with the source.

In one embodiment, the cylinder includes an end wall having thereon the valve seat, and the piston has an end facing the end wall, and the valve member biasing means includes a spring extending between the end wall and the end of the piston.

A principal feature of the invention is the provision of warning means which utilizes the negative pressure spikes generated in a two cycle engine crankcase to produce an audible signal. Operation of the warning means reduces pressure in the crankcase and results in an accompanying reduction in power to the engine such that the engine can not be operated at full power as long as the liquid pressure is low.

Another principal feature of the invention is the provision of a valve apparatus which periodically allows pneumatic communication between the warning means and the engine's crankcase in response to an engine liquid pressure below a specific value.

Other features and advantages of the invention will become apparent to those skilled in the art upon review of the following detailed description, claims and drawings.

Figure 1:
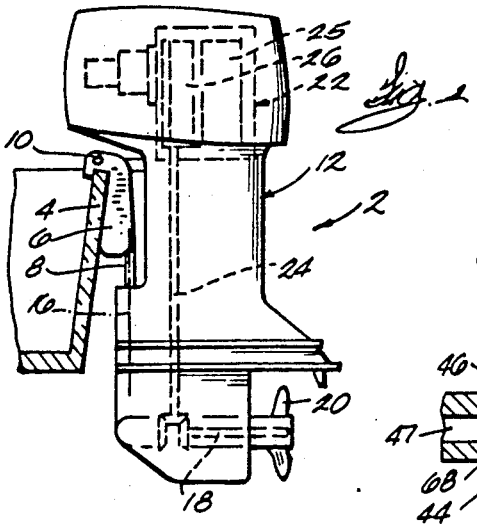
FIG. 1 is a side view of a marine propulsion device embodying various features of the invention and including an apparatus for detecting a low liquid pressure condition in an internal combustion engine.

Before at least one embodiment of the invention is explained in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

A marine propulsion device 2 embodying the invention is illustrated in the drawings.

The marine propulsion device 2 comprises mounting means adapted to be mounted on the transom 4 of a boat. While various suitable mounting means can be employed, in the preferred embodiment, the mounting means includes a transom bracket 6 mounted on the transom 4. The mounting means also includes a swivel bracket 8 mounted on the transom bracket 6 for pivotal movement relative to the transom bracket 6 about a generally horizontal tilt axis 10.

Figure 2:
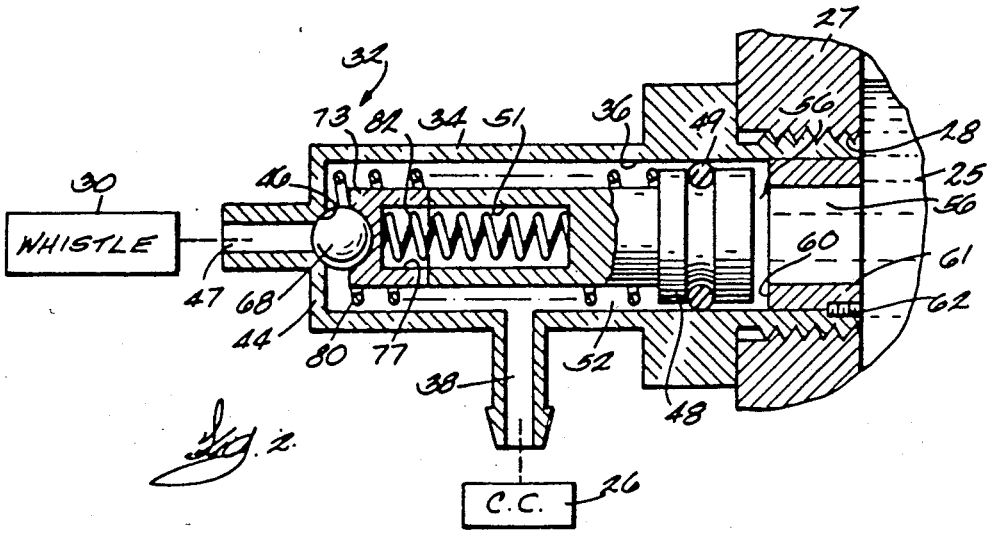
FIG. 2 is a side view, partially in section, of the apparatus including a pressure sensitive valve means in a first position wherein the pressure is not low and a pneumatic horn is not in communication with the crankcase.

The marine propulsion device 2 also comprises a propulsion unit 12 mounted on the swivel bracket 8 for pivotal movement relative thereto about a generally vertical steeringaxis 16. The propulsion unit 12 includes a propeller shaft 18 rotatably supporting a propeller 20, and an internal combustion engine 22 drivingly connected to the propeller shaft 18 via a conventional drive train 24. The internal combustion engine 22 is preferably a two-cycle engine having a water jacket 25 and a crankcase 26, the crankcase 26 providing a zone of alternating high and low pressures. The internal combustion engine 22 also includes (see FIGS. 2–4) a wall 27 defining a cavity adapted to house a fluid under pressure. The cavity is preferably the water jacket 25. As shown in FIG. 2, the wall 27 has therein a cavity bore 28.

The marine propulsion device 2 also includes a source of gas with a pressure different from atmospheric pressure. In the preferred embodiment, the source of gas includes the crankcase 26 (FIG. 1) of the internal combustin engine 22.

The marine propulsion 2 also includes (see FIG. 2) pneumatic warning means 30 for producing a warning signal in response to communication between the crankcase 26 and the warning means 30. While various suitable pneumatic warning means can be employed, in the preferred embodiment, the pneumatic warning means 30 is a whistle.

The marine propulsion device 2 also includes valve means 32 for permitting communication between the crankcase 26 and the warning means 30 when the liquid pressure in the water jacket 25 is below a specified value and for preventing communication between the crankcase 26 and the warning means 30 when the liquid pressure is above the specified value. While various suitable valve means may be employed, in the preferred embodiment, the valve means 32 includes a cylinder 34 defining a cylinder bore 36 communicating with the water jacket 25. In the illustrated construction, cylinder 34 has a right end that is threaded into the cavity bore 28. The cylinder 38 also has therein a passageway 38 communicating between the cylinder bore 36 and the crankcase 26 and communicable with the warning means 30 as described below. The cylinder 34 also has an end wall 44 having thereon a spherical valve seat 46. The valve seat 46 defines an opening to a passageway 47 which communicates with the warning means 30 and which is communicable with the cylinder bore 36 as described below.

Figure 4:
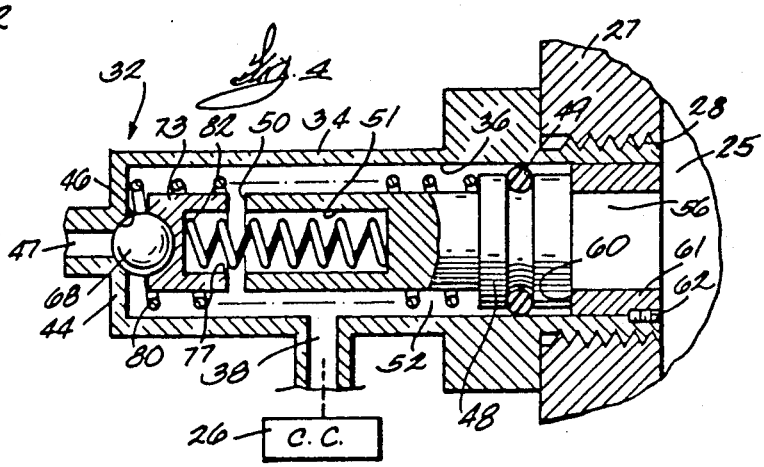
FIG. 4 is a cross-sectional view of the valve means in a third position wherein the pressure is low and the pneumatic horn is not in communication with the crankcase.
Figure 3:
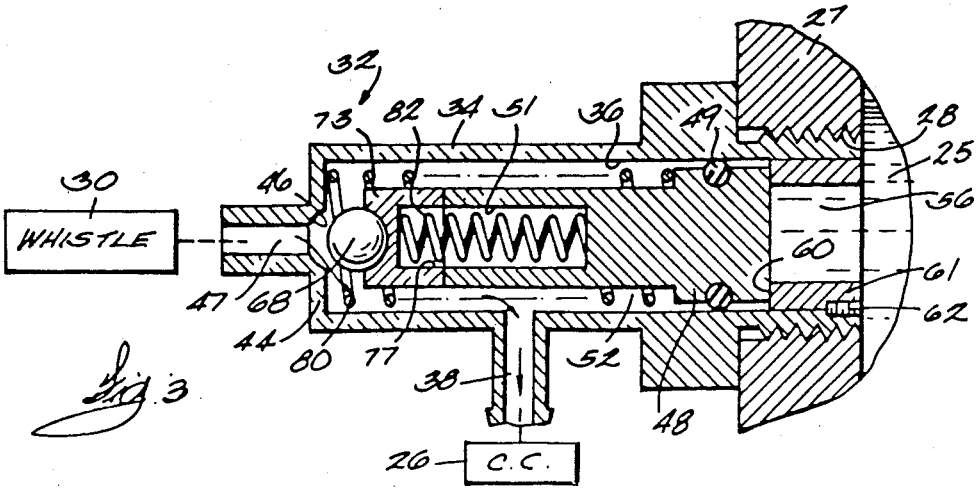
FIG. 3 is a cross-sectional view of the valve means in a second position wherein the pressure is low and the pneumatic horn is in communication with the crankcase.

The valve means 32 also includes a piston 48 which is slidably housed by the cylinder 34 and which has thereon an o-ring 49 such that the piston 48 sealingly engages the cylinder 34. The piston 48 has an end 50 (best shown in FIG. 4) facing the end wall 44 and having therein a recess 51. The piston 48 divides the cylinder bore 36 into a first or left chamber 52 and a second or right chamber 56. The first chamber 52 is located between the piston 48 and the end wall 44, and the second chamber 56 is located between the piston 48 and the water jacket 25. The valve means 32 also includes stop means for preventing the piston 48 from entering the water jacket 25. While various suitable stop means can be employed, in the preferred embodiment, such stop means includes, in the cylinder 34, a step 60 which is located in the second chamber 56 and which is engageable with the piston 48, as shown in FIGS. 3 and 4. Preferably, the step 60 is defined by an annular member 61 fixed axially of the cylinder 34 by a set screw 62.

The valve means 32 also includes a generally spherical ball valve member 68 which is located in the first chamber 52 and which is movable into and out of sealing engagement with the valve seat 46 for respectively closing and opening the passageway 47 to the firstchamber 52. The valve means 32 also includes a ball carrier 73 located in the first chamber 52 and adapted to hold the ball valve member 68. In the illustrated construction, the ball carrier 73 has therein a recess 75 having a spherical section and facing the valve seat 46 for holding the ball valve member 68. The ball carrier 73 also has therein a recess 77 facing the piston recess 51.

The valve means 32 also includes means for biasing the piston 48 away from the end wall 44 or in the direction minimizing the volume of the right chamber 56. While varius suitable biasing means can be employed, in the preferred embodiment, such means includes a piston return spring 80 extending between the end wall 44 and the piston 48 such that the spring 80 biases the piston 48 towards the stop means 60.

The valve means 32 also includes means for biasing the ball valve member 68 toward the valve seat 46 when the volume of the chamber 52 is greater than a predetermined volume (the volume shown in FIG. 2). While various suitable biasing means can be employed, in the preferred embodiment, such means includes a ball member spring 82 partially housed by the piston recess 51 and the ball carrier recess 77 such that the ball member spring 82 biases the ball carrier 73 and the valve member 68 towards the valve seat 46 and biases the piston 48 towards the stop means 60.

As illustrated in FIG. 2, during normal operation of the engine 22, the valve means 32 is closed, not allowing communication between the crankcase 26 and the warning means 30. During normal operation of the engine 22, the pressure exerted against the piston 48 by the liquid housed in the cavity 25 biases the piston 48 to the left or toward the end wall 44 and against the piston return spring 80, thereby minimizing the volume of the first chamber 52. The piston end 50 engages the ball carrier 73 and forces the ball valve member 68 against the valve seat 46 to close off the passageway 47 between the crankcase 26 and the pneumatic warning means 30. Thus, the piston 48 and the ball carrier 73 constitutes means for moving the valve member 68 into engagement with the valve seat 46 when the volume of the first chamber 52 is less than or equal to the above-mentioned predetermined volume (the volume shown in FIG. 2).

As shown in FIGS. 3 and 4, however, in the event that the liquid pressure falls below the specified value, the piston return spring 80 exerts a sufficient force to bias the piston 48 to the right or in the direction minimizing the volume of the second chamber 56, until the piston is seated against the step 60. At this point, the volume of the first chamber 52 is greater than the above-mentioned predetermined volume, and the spring 82 biases the valve member 68 toward the valve seat 46. The ball valve member 68 then acts against the ball member spring 82 under the influence of negative pressure pulses provided by the crankcase 26, thereby opening the passageway 47 (FIG. 3) and allowing air to flow through the pneumatic warning means and into the crankcase.

As the engine 22 cycles and the crankcase pressure increases, the ball member return spring 82 biases the ball valve member 68 to the left or towards the valve seat 46. As illustrated in FIG. 4, the ball valve member 68 is then seated against the valve seat 46, thereby disrupting communication between the warning means 30 and the crankcase 26.

Thus, the valve means 32 permits opening of the passageway 47 in response to movement of the piston 48 in the direction minimizing the volume of the second chamber 56 and prevents opening of the passageway 47 in response to movement of the piston 48 in the direction minimizing the volume of the first chamber 52.

The periodic disruption of communication between the warning means 30 and the crankcase 26 corresponding to the alternating pressures in the crankcase 26 results in an audible chirping by the whistle 30. Thus, the pneumatic warning means 30 generates an audible low liquid pressure warning. Upon hearing the audible engine liquid low pressure warning, an operator using the marine propulsion device 2 can shut off the internal combustion engine 22 in order to avoid engine damage resulting from the lowliquid pressure condition.

Various of the features of the invention are set forth in the following claims.

I claim:

1. A marine propulsion device comprising a propulsion unit including a propeller shaft adapted to support a propeller, and an internal combustion engine drivingly connected to said propeller shaft and including a cooling jacket adapted to contain coolant under pressure, means for providing gas at a pressure different from atmospheric pressure, pneumatic warning means for producing a warning signal in response to communicationbetween said gas providing means and said warning means, valve means movable between a first position permitting communication between said gas providing means and said warning means when the pressure of said coolant is below a specified value and a second position preventing communication between said gas providing means and said warning means when the pressure of said coolant is above said specified value, and a spring biasing said valve means toward said first position.

2. A marine propulsion device in accordance with claim 1 wherein said engine includes said gas providing means.

3. A marine propulsion device in accordance with claim 2 wherein said engine is a two-cycle engine having a crankcase, and wherein said crankcase is said gas providing means.

4. An engine apparatus comprising an internal combustion engine including a cooling jacket adapted to contain coolant under pressure, means for providing gas at a pressure different from atmospheric pressure, pneumatic warning means for producing a warning signal in response to communication between said gas providing means and said warning means, and valve means for permitting communication between said gas providing means and said warning means when the pressure of said coolant is below a specified value and for preventing communication between said gas providing means and said warning means when the pressure of said coolant is above said specified value.

5. An engine apparatus as set forth in claim 4 wherein said engine includes said gas providing means.

6. An engine apparatus as set forth in claim 5 wherein said engine is a two-cycle engine having a crankcase, and wherein said crankcase is said gas providing means.

7. A marine propulsion device comprising a propulsion unit including a propeller shaft adapted to support a propeller, and an internal combustion engine drivingly connected to said propeller shaft and including a cooling jacket adapted to contain coolant under pressure, means for providing gas at a pressure different from atmospheric pressure, pneumatic warning means for producing a warning signal in response to communication between said gas providing means and said warning means, a cylinder defining a cylinder bore, a passageway communicating with one of said gas providing means and said warning means, a piston dividing said cylinder bore into a first chamber communicating with the other of said gas providing means and said warning means and being communicable with said passageway, and a second chamber communicating with said cooling jacket, valve means for affording communication of said passageway with said first chamber in response to movement of said piston in the direction minimizing the volume of second chamber, and for preventing communication of said passageway with said first chamber in response to movement of said piston in the direction minimizing the volume of said first chamber, and a spring located in said first chamber and biasing said piston in the direction minimizing the volume of said second chamber.

8. A marine propulsion device as set forth in claim 7 wherein said cylinder includes an end wall, and wherein said valve means includes means for biasing said piston in the direction minimizing the volume of said second chamber, said piston biasing means including a piston return spring extending between said end wall and said piston.

9. A marine propulsion device as set forth in claim 7 wherein said engine includes a crankcase, and wherein said gas providing means is said crankcase.

10. A marine propulsion device as set forth in claim 7 wherein saidpassageway communicates with said gas providing means.

11. A marine propulsion device as set forth in claim 7 wherein said cylinder includes a step engageable with said piston for preventing said piston from entering said cooling jacket.

12. A marine propulsion device comprising a propulsion unit including a propeller shaft adapted to support a propeller, and an internal combustion engine drivingly connected to said propeller shaft and including a cavity adapted to house a liquid under pressure, means for providing gas at a pressure different from atmospheric pressure, pneumatic warning means for producing a warning signal in response to communication between said gas providing means and said warning means, a cylinder defining a cylinder bore, a passageway communicating with one of said gas providing means and said warning means, a piston dividing said cylinder bore into a first chamber communicating with the other of said gas providing means and said warning means and being communicable with said passageway, and a second chamber communicating with said cavity, and valve means for affording communication of said passageway with said first chamber in response to movement of said piston in the direction minimizing the volume of said second chamber, and for preventing communication of said passageway with said first chamber in response to movement of said piston in the direction minimizing the volume of said first chamber, said valve means including a valve seat, a valve member movable into and out of engagement with said valve seat for respectively preventing communication and affording communication with said passageway, means for biasing said valve member toward said valve seat when the volume of said first chamber is greater than a predetermined volume, and means for moving said valve member into engagement with said valve seat when the volume of said first chamber is less than or equal to said predetermined volume.

13. A marine propulsion device as set forth in claim 12 wherein said cylinder includes an end wall having thereon said valve seat, wherein said piston has an end facing said end wall, and wherein said valve member biasing means includes a spring extending between said end wall and said end of said piston.

14. A marine propulsion device as set forth in claim 12 wherein said means for moving said valve member into engagement with said valve seat when the volume of said firsat chamber is less than or equal to said predetermined volume includes said piston.

15. A marine propulsion device comprising a propulsion unit including a propeller shaft adapted to support a propeller, and an internal combustion engine drivingly connected to said propeller shaft and including a cooling jacket adapted to contain coolant under pressure, means for providing gas at a pressure different from atmospheric pressure, pneumatic warning means for producing a warning signal in response to communication between said gas providing means and said warning means, valve means for permitting communication between said gas providing means and said warning means when the pressure of said coolant is below a specified value and for preventing communication between said gas providing means and said warning means when the pressure of said coolant is above said specified value, and a spring biasing said valve means so as to permit communication between said gas providing means and said warning means.

* * * * *